US006029679A

United States Patent [19]

Ota et al.

[11] Patent Number: 6,029,679

[45] Date of Patent: Feb. 29, 2000

[54] SEMICONDUCTOR CLEANING AND PRODUCTION METHODS USING A FILM REPULSING FINE PARTICLE CONTAMINANTS

[75] Inventors: Katsuhiro Ota, Yokohama; Haruo Itoh, Hino; Akio Saito, Yokohama; Katsuhiko Itoh, Tokyo; Michimasa Funabashi, Fuchu, all of Japan

[73] Assignee: Hitachi, Ltd., Tokyo, Japan

[21] Appl. No.: 08/708,325

[22] Filed: Sep. 5, 1996

[30] Foreign Application Priority Data

Sep. 7, 1995 [JP] Japan ..... 7-229887

[51] Int. Cl.[7] ..... B08B 6/00; C25F 1/00; C25F 3/30; C25F 5/00

[52] U.S. Cl. ..... 134/1.3; 134/2; 134/3

[58] Field of Search ..... 134/22.14, 22.19, 134/902, 1.3, 2, 3; 437/946; 156/638

[56] References Cited

U.S. PATENT DOCUMENTS

| | | | |
|---|---|---|---|
| 5,079,129 | 1/1992 | Roth et al. | 430/280 |
| 5,409,544 | 4/1995 | Ota et al. | 134/22.14 |
| 5,472,513 | 12/1995 | Shiramizu | 134/3 |
| 5,557,147 | 9/1996 | Sugiura et al. | 257/763 |
| 5,614,352 | 3/1997 | Rahman | 430/270.1 |

*Primary Examiner*—Laurie Scheiner
*Assistant Examiner*—J. S. Parkin
*Attorney, Agent, or Firm*—Antonelli, Terry, Stout & Kraus, LLP

[57] ABSTRACT

By employing a cleaning method wherein a substrate such as Si wafer is covered with a film having electrostatic repulsive force or a substance capable of controlling a zeta potential so as to prevent or remarkably reduce adhesion of fine particles present in a cleaning solution or etching solution, electronic parts can be produced in higher yield and lower cost.

44 Claims, 10 Drawing Sheets

SEMICONDUCTOR CLEANING AND PRODUCTION METHODS USING A FILM REPULSING FINE PARTICLE CONTAMINANTS

BACKGROUND OF THE INVENTION

This invention relates to a method for cleaning samples of compounds containing inorganic or organic materials during producing processes of electronic materials, magnetic materials, optical materials, ceramics, etc., and a process for producing products such as semiconductor devices using the cleaning method. Particularly, this invention relates to a cleaning method suitable for preventing or remarkably reducing adhesion of fine particles on semiconductor substrate surfaces and a process for producing a semiconductor device using said cleaning method.

Integrated circuit formed on a surface of a substrate such as a semiconductor wafer, etc. has recently been increased in level of integration, and thus the line width of pattern becomes finer and finer. In the next stage 64 M DRAMs, the minimum fabrication size is 0.3 $\mu$m and finer particles will become a bar for improving the quality and yield of products in their production processes.

Heretofore, as a means for cleaning a substrate surface, there is a method in which a mixed solution of ammonia water and hydrogen peroxide solution is heated to about 80° C. and a wafer is immersed therein, or a method in which a wafer is subjected to ultrasonic wave treatment in ultrapure water, as disclosed in RCA Review, 31 (1970), pp. 187–206.

Further, there is also a method wherein $SiO_2$ film 39 (shown in FIG. 16) is removed by wet etching without removing a resist 37. According to this method, as shown in FIG. 16, a $SiO_2$ film 39 and a poly Si film 40 are formed on a poly Si film 38, and used for forming a fin structure. Then, the resist 37 and $SiO_2$ film 39 are removed, followed by formation of $Si_3N_4$ (not shown in FIG. 16) on the poly Si 38 and 40 to give 1.5 fins structure.

Considering higher density of the level of integration in the integrated circuit and the minimum fabrication size of 0.3 $\mu$m in the next stage 64 M DRAMs, the size of fine particles to be cleaned becomes smaller and small, and it will be necessary to remove even fine particles having a size of 0.03 $\mu$m.

With a reduction of the size of fine particles, the amount of fine particles in the air also increases. Thus, the amount of fine particles of 0.03 $\mu$m will be present several times as large as that of fine particles of 0.05 $\mu$m now produced (16 M DRAMs). Further, with the reduction of size of fine particles, these fine particles will more easily adhere to a substrate, resulting in requiring cleaning technique for the fine particles more often.

But, according to a prior art technique for removing fine particles from a substrate using mechanical force such as ultrasonic wave, since the mass and surface area are also reduced with a reduction of size of fine particles, the chargeable mechanical force per particle decreases and thus it becomes difficult to remove the fine particles. Further, damages on substrates also become a problem with an increase of level of integration of semiconductors. Thus, it will be impossible to remove very finer particles according to the prior art techniques.

For example, the use of a mixed aqueous solution of hydrofluoric acid and ammonium fluoride is considered. Fine particles present in such a mixed aqueous solution seem to be derived from those generated by various factors such as removal of fine particles attached to a rear side of a semiconductor wafer, and those generated newly by etching of an oxide film. Particularly in the latter case, the fine particles include those having Si as a major component and generated by chemical reactions, and the like at the time of etching of the oxide film, those of reaction products attached to the substrate prior to the etching such as dry etching of the oxide film and released by etching. It is very difficult to prevent such fine particles generated by the latter case from adhesion to the substrate, even if the above-mentioned mixed aqueous solution and the rear side of semiconductor wafer are made clean.

Further, in the case of 1.5 fins structure mentioned above, since the poly Si film surface 38 (see FIG. 16) is exposed after wet etching of the $SiO_2$ film 39, fine particles are adhered to the poly Si film surface 38. More concretely, fine particles were adhered to the product in an amount of 0.9 particle/$cm^2$ or more.

Such fine particles adhered to the wafer become one of major factors for reducing the yield of products in the production of semiconductor devices.

SUMMARY OF THE INVENTION

It is an object of the present invention to provide a cleaning method for preventing or reducing remarkably adhesion of fine particles on surfaces of semiconductor devices using a cleaning solution such as a hydrofluoric acid solution, a mixed aqueous solution of hydrofluoric acid and ammonium fluoride, etc. in the step of cleaning semiconductor devices, and a process for producing semiconductor devices using such a cleaning method so as to produce semiconductor devices such as semiconductor integrated circuits, etc. in high yield.

The present invention provides a cleaning method which comprises:

- a step of forming on a substrate a first film with a material which is easily subjected to adhesion of fine particles equal to or easier than single crystal silicon,
- a step of forming a second film having electrostatic repulsive force against the fine particles so as to cover the first film, and
- a step of cleaning the substrate covered with the second film using a cleaning solution containing fine particles.

The present invention further provides a process for producing a semiconductor device which comprises:

- a step of forming on a substrate a first film with a material which is easily subjected to adhesion of fine particles equal to or easier than single crystal silicon,
- a step of forming a second film having electrostatic repulsive force against the fine particles on the first film,
- a step of forming a third film on the second film,
- a step of forming a resist film having a desired form on the third film,
- a step of dry etching the third film using the resist film as a mask and the second film as a stopper, and
- a step of immersing the substrate forming the resist film thereon in a cleaning solution.

DESCRIPTION OF THE PREFERRED EMBODIMENTS

Figure 1A:
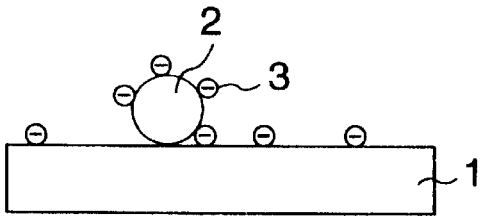
FIGS. 1A and 1B are schematic sectional views explaining the inventive idea of prevention of a substrate surface covered with a special substance from adhesion of fine particles by electrostatic repulsive force.

The above-mentioned object can be attained by formation of a film having larger electrostatic repulsive force against fine particles so as to cover a substrate or a film which is easily subjected to adhesion of fine particles. By this, it becomes possible to prevent a substrate surface from adhesion of fine particles in a solution such as a cleaning solution. Further, the cleaning method of the present invention is particularly effective for cleaning a film which is easily subjected to adhesion of fine particles equal to or easier than single crystal silicon. More concretely, fine particles easily adhere to an aluminum film and a polysilicon film, so that the cleaning method of the present invention is particularly effective for these films.

The present invention has the following Embodiments.

(1) A cleaning method which comprises:

a step of forming on a substrate a first film with a material which is easily subjected to adhesion of fine particles, for example, present in a cleaning solution, equal to or easier than a single crystal silicon, a step of forming a second film having electrostatic repulsive force against the fine particles so as to cover the first film, and a step of cleaning the substrate covered with the second film using the cleaning solution so as to prevent or reduce remarkably the adhesion of fine particles to the substrate.

(2) A cleaning method which comprises:

a step of forming an aluminum film on a substrate, a step of forming a second film having electrostatic repulsive force against fine particles present in a cleaning solution so as not to expose the aluminum film, and a step of cleaning the substrate covered with the second film using the cleaning solution so as to prevent or reduce remarkably the adhesion of fine particles to the substrate.

(3) A cleaning method which comprises:

a step of forming a polysilicon film on a substrate, a step of forming a second film having electrostatic repulsive force against almost fine particles present in a cleaning solution so as not to expose the polysilicon film, and a step of cleaning the substrate covered with the second film using the cleaning solution so as to prevent or reduce remarkable the adhesion of fine particles to the substrate.

(4) A cleaning method which comprises:

cleaning a substrate on which a film having a zeta potential of 25 mV or more in an absolute value in a cleaning solution has been formed using the cleaning solution so as to prevent or reduce the adhesion of fine particles to the substrate.

(5) A cleaning method which comprises:

a step of forming on a substrate a first film with a material which is easily subjected to adhesion of fine particles, e.g. present in a cleaning solution, equal to or easier than single crystal silicon, a step of forming two or more films having electrostatic repulsive force against the fine particles so as not to expose the first film, and a step of cleaning the substrate covered with the two or more films by immersing the substrate in a cleaning solution so as to prevent or reduce remarkably the adhesion of fine particles to the substrate.

(6) A cleaning method which comprises:

a step of forming on a substrate a first film with a material which is easily subjected to adhesion of fine particles, e.g. present in a cleaning solution, equal to or easier than single crystal silicon, a step of forming a second film with at least one member selected from the group consisting of a resist, $Si_3N_4$ and $SiO_2$ so as not to expose the first film, and a step of cleaning the substrate covered with the second film using the cleaning solution so as to prevent or reduce remarkably the adhesion of fine particles to the substrate.

(7) A cleaning method in Embodiment (6), wherein the resist is as a photosensitive resin at least one member selected from the group consisting of novolak resins, cyclized natural rubbers, cyclized synthetic rubbers, polyvinyl cinnamate, poly(methyl isopropenyl ketone), polyvinyl phenol, photosensitive polyimides, polyvinyl-p-azidobenzoate, polymethacryloyl oxybenzal acetophenone, polyvinyl cinnamylidene acetate, poly(methyl methacrylate), 4,4'-diazidodiphenyl sulfide, poly-4-vinyl phenol, 3,3'-diazidodiphenylsulfone, chloromethylated polystyrene, styrenated polymers bound to 2,4-dichlorobenzoic acid derivatives, chlorinated styrene polymers, hexafluorobutyl methacrylate polymers, tetrafluoropropyl methacrylate polymers, naphthoquinone diazide compound, methyl methacrylate-acrylonitrile copolymer, poly(glycidyl methacrylate), poly(2-methyl-1-pentene sulfone), iodinated polystyrene, poly(α-cyano acrylate), poly(hexafluorobutyl methacrylate), poly(dimethyltetrafluoropropyl methacrylate), poly(trichloroethyl methacrylate), poly (trifluoroethyl-α-chloroacrylate), polymethacrylates introducing methyl maleate into side chain(s), chlorinated polymethylsulfone, novolak-benzoquinone diazide, trichloroethyl methacrylate polymer, trifluoroethyl chloroacrylate polymer, polymethacrylates, ethyl acrylate copolymers, and sulfone copolymers.

(8) A cleaning method in Embodiment (6) or (7), wherein the resist is as a photosensitive agent at least one member selected from the group consisting of o-naphthodiazide compounds, bisazide compounds, sensitizers, α-naphthoquinone diazide compounds, and 4-azide chalcone.

(9) A cleaning method which comprises:

a step of forming an aluminum film on a substrate, a step of forming a second film with at least one member selected from the group consisting of a resist, $Si_3N_4$ and $SiO_2$ so as not to expose the first film, and a step of cleaning the substrate covered with the second film using a cleaning solution so as to prevent or reduce remarkably the adhesion of fine particles to the substrate.

(10) A cleaning method which comprises:

a step of forming a polysilicon film on a substrate, a step of forming a second film with at least one member selected from the group consisting of a resist, $Si_3N_4$ and $SiO_2$ so as to cover the polysilicon film, and a step of cleaning the substrate covered with the second film using a cleaning solution so as to prevent or reduce remarkably the adhesion of fine particles to the substrate.

(11) A cleaning method which comprises:

a step of forming on a substrate a first film with a material which is easily subjected to adhesion of fine particles, e.g. present in a cleaning solution, equal to or easier than single crystal silicon, a step of forming an organic film so as not to expose the first film, and a step of cleaning the substrate covered with the organic film using a cleaning solution.

(12) A cleaning method in Embodiment (11), wherein the first film is an aluminum film or a polysilicon film.

(13) A cleaning method in Embodiment (11) or (12), wherein the organic film has one or more polar groups.

(14) A cleaning method in Embodiment (11), wherein the organic film has at least one member selected from the group consisting of a hydroxyl group, an ester linkage, an acid-amide linkage and an ether linkage.

(15) A cleaning method which comprises:

cleaning a substrate on which a film having a zeta potential of 25 mV or more in an absolute value in a cleaning solution has been formed, by immersing the substrate in the cleaning solution, said cleaning solution being one member selected from the group consisting of (A) an acidic solution containing at least one of hydrofluoric acid, hydrochloric acid, sulfuric acid, nitric acid, acetic acid, and organic acids, (B) an acidic solution comprising an inorganic or organic acid, hydrogen peroxide solution, and ammonium fluoride, (C) an alkaline solution comprising at least one member selected from the group consisting of ammonia water and amines, (D) an alkaline solution comprising at least one of ammonia water and amines, and hydrogen peroxide solution and ammonum fluoride, (E) a mixture comprising at least one of the acidic solutions of (A) and (B), and at least one of the alkaline solutions of (C) and (D), and (F) a neutral solution, such as ultra-pure water.

(16) A cleaning method in Embodiment (15), wherein the cleaning solution further comprises a cationic surfactant, an anionic surfactant, or an ampholytic surfactant, and an organic solvent.

(17) A cleaning method which comprises:

a step of forming on a substrate a first film with a material which is easily subjected to adhesion of fine particles, e.g. present in a cleaning solution, equal to or easier than single crystal silicon, a step of forming a second film having electrostatic repulsive force against almost fine particles present in a cleaning solution so as to cover the first film, and a step of cleaning the substrate covered with the second film using a cleaning solution having a pH of 1 to 4 so as to prevent or reduce remarkably the adhesion of fine particles to the substrate.

(18) A cleaning method which comprises:

cleaning a substrate on which a film having a zeta potential of 25 mV or more in an absolute value in a cleaning solution has been formed using a cleaning solution having a pH of 1 to 4.

(19) A cleaning method which comprises:

forming a film having electrostatic repulsive force against almost fine particles present in a cleaning solution on a substrate so as not to expose the substrate, and cleaning the substrate by immersing the substrate in the cleaning solution so as to prevent or reduce remarkably the adhesion of fine particles to the substrate.

(20) A process for producing a semiconductor device which comprises:

a step of forming on a substrate a first film with a material which is easily subjected to adhesion of fine particles, e.g. present in a cleaning solution, equal to or easier than single crystal silicon, a step of forming a second film having electrostatic repulsive force against the fine particles on the first film, a step of forming a third film on the second film, a step of forming a resist film having a desired form on the third film, a step of dry etching the third film using the resist film as a mask and the second film as a stopper, and a step of immersing the substrate forming the resist film thereon in a cleaning solution.

(21) A process for producing a semiconductor device which comprises:

a step of forming a first film having a zeta potential of 25 mV or more in an absolute value in a solution, on a substrate, a step of forming a second film having electrostatic repulsive force against almost fine particles present in the solution on the first film, a step of forming a third film on the second film, a step of forming a resist film having a desired form on the third film, a step of dry etching the third film using the resist film as a mask and the second film as a stopper, and a step of immersing the substrate forming the resist film thereon in the solution.

(22) A process for producing a semiconductor device which comprises:

a step of forming a first film with a material which is easily subjected to adhesion of fine particles, e.g. present in a solution, equal to or easier than single crystal silicon, on a substrate, a step of forming a second film on the first film, a step of forming a laminated film comprising a third film and a polysilicon film on the second film, a step of forming a resist film on the laminated film, a step of dry etching the laminated film using the resist film as a mask and the second film as a stopper, and a step of wet etching the third film while immersing the substrate forming the resist film thereon in a solution.

The present invention is explained in detail referring to the drawings.

Figure 1B:
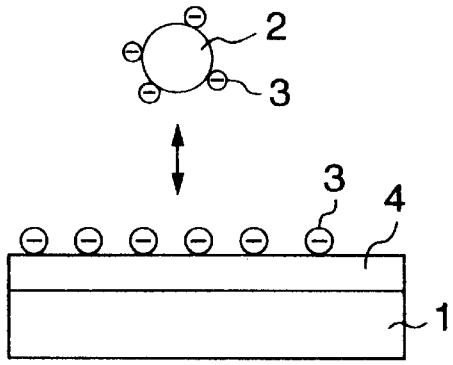

FIGS. 1A and 1B are schematic sectional views explaining the inventive idea of prevention of a substrate covered with a special substance from adhesion of fine particles by electrostatic repulsive force. In FIG. 1A, since the electrostatic repulsive force between a substrate 1 and a fine particle 2 is small, the fine particle adheres to the substrate. In FIG. 1B, since the substrate 1 is covered with a special substance 4 so as to increase the electrostatic repulsive force, the adhesion of fine particle is prevented. In FIGS. 1A and 1B, numeral 3 denotes surface charge.

Figure 2A:
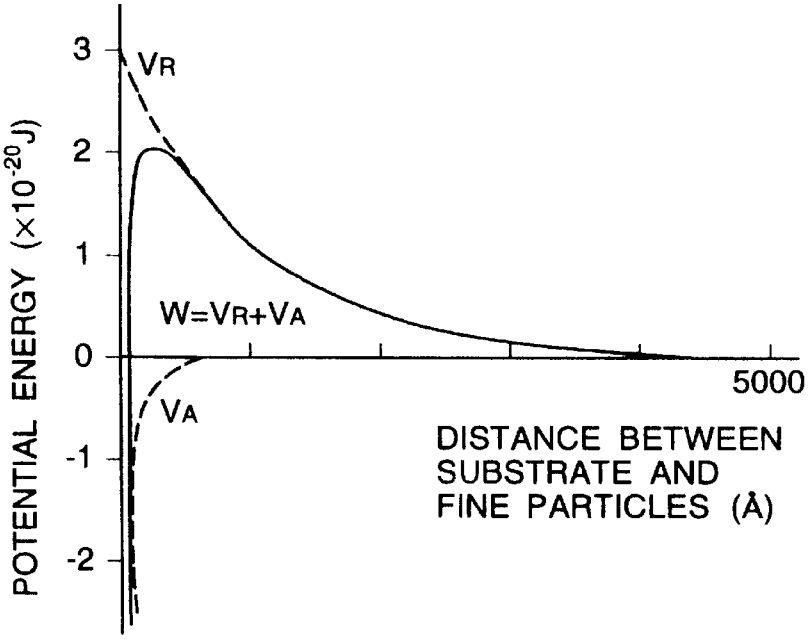
FIGS. 2A to 2C are schematic illustrations showing a relation between the substrate-fine particle distance and the potential energy.
Figure 2B:
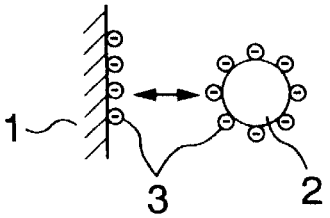
Figure 2C:
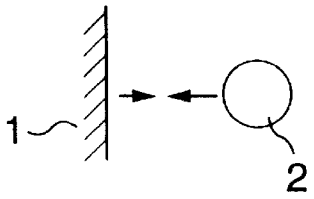

FIGS. 2A to 2C show the fundamental idea of the present invention. FIG. 2A shows a relationship between the substrate-fine particle distance and the potential energy (W). FIG. 2B is a schematic illustration showing the electrostatic repulsive force caused by an electric double layer formed by the surface charge 3 between the substrate 1 and the fine particle 2. FIG. 2C is a schematic illustration showing the attractive force caused by van der Waals force between the substrate 1 and the fine particle 2. As shown in FIG. 2A, the potential energy W between the substrate 1 and the fine particle 2 in the solution is the sum of the attractive force (VA) by van der Waals force and the electrostatic repulsive force (VR) by the electric double layer, that is, W=VA+VR. By passing the hill (or height) of the potential, it seems that the fine particle adheres to the substrate. Thus, the present invention has been attained by noticing that in order to make the hill of potential higher and to reduce the adhesion of fine particle to the substrate, it is effective to make the absolute value of the surface potential of the substrate (this can be measured as a zeta potential value by an experiment) high so as to enhance the electrostatic repulsive force.

Figure 3:
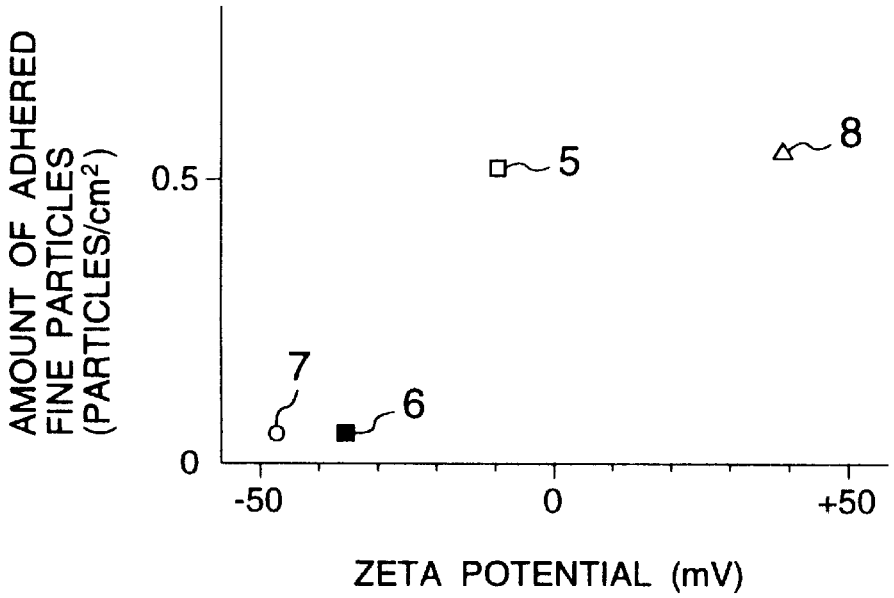
FIGS. 3 and 4 are graphs showing a relationship between the amount of adhered fine particles and the zeta potential.

FIG. 3 is a graph showing a relationship between the amount of adhered fine particles to the substrate and the zeta potential. In FIG. 3, numeral 5 is the case of Si particles subjected to etching treatment with hydrofluoric acid (after immersing in hydrofluoric acid solution [HF:$H_2O$=1:99 by volume, concentration of commercially available HF being 50%, hereinafter the same thing is applied], fine particles are collected by using a filter, hereinafter referred to as "bare Si particles"), numeral 6 is the case of Si particles without the treatment, numeral 7 is the case of polystyrene particles, and numeral 8 is the case of $Al_2O_3$ particles. As shown in FIG. 3, the zeta potentials are different depending on the kinds of particles. Further, even in the case of Si particles, zeta potential values are different depending on differences in surface states. Thus, the amount of adhered fine particles to the substrate also changes. Therefore, it is possible to prevent or reduce the adhesion of fine particles to the substrate by controlling the zeta potential.

Further, the zeta potentials of the substrate and the fine particles are generally negative. But, both can be positive, for example, in the case of alumina substrate and alumina particles. Therefore, in the present invention, to control the zeta potential means to make the absolute value of the zeta potential large.

Mechanism of charging the substrate and the fine particles, etc. is explained, for example, in Ayao Kitahara: "Chemistry of Dispersed and Emulsified System", pages 77 to 79 (published by Kohgaku Tosyo in 1979).

According to the present invention, by covering the substrate with a substance which can control zeta potentials, the absolute value of zeta potential of the substrate in a solution such as a cleaning solution is made large, so that the electrostatic repulsive force between the substrate and the fine particles in the solution increases. As a result, the potential energy between the fine particles and the substrate is enhanced and it becomes possible to prevent or reduce the adhesion of fine particles to the substrate.

At the same time, by applying the cleaning method of the present invention, it becomes possible to produce semiconductor devices with higher quality in higher yield compared with the prior art technique.

Figure 4:
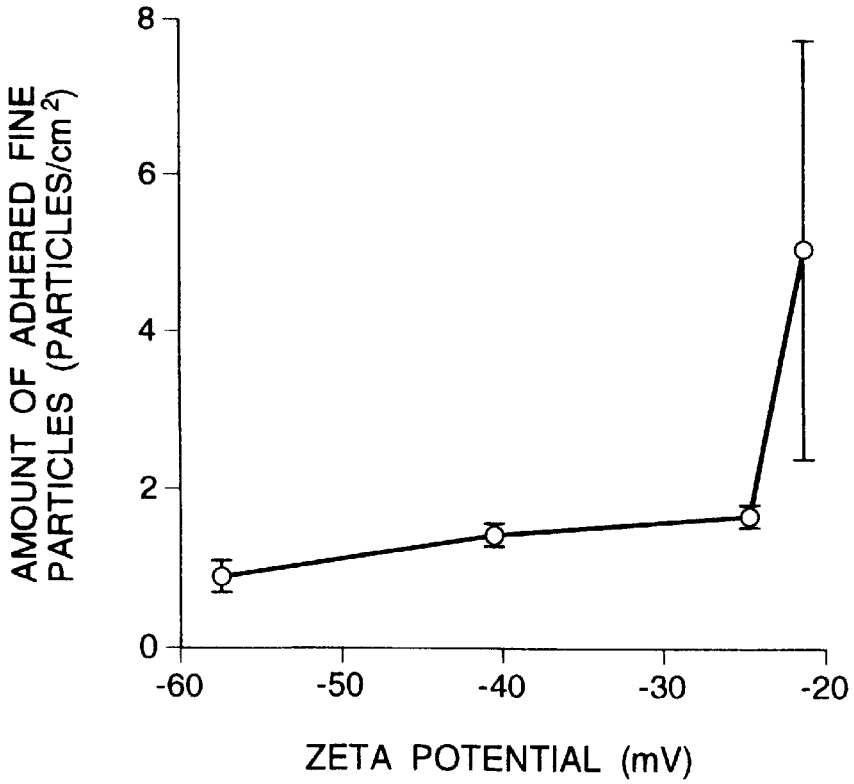

Dependency of the amount of adhered fine particles on the zeta potential is shown in FIG. 4. In this experiment, a Si wafer was immersed in a mixed aqueous solution of hydrofluoric acid (20% by volume) and ammonium fluoride dispersing Si particles therein, and the amount of adhered fine particles was measured. The zeta potential is controlled by the adding amount of a surfactant. The amount of adhered fine particles near the zeta potential of −20 mV is as large as 2 to 8 particles/$cm^2$ with a large deviation. When the zeta potential is −25 mV or less, the amount of adhered fine particles becomes 2 particles/$cm^2$ or less. This means that the object of the present invention can be attained by making the absolute value of the zeta potential of the substrate about 25 mV or more by covering the substrate with a special substance. The dependency of the amount of adhered fine particles on the zeta potential can also be admitted in the case of using hydrofluoric acid. Further, the threshold value of zeta potential changes depending on the ion concentration in the solution (e.g. cleaning solution) and the composition of the solution (e.g. cleaning solution).

When the amount of adhered fine particles is 0.1 particle/$cm^2$ or less, the yield is improved remarkably.

The present invention is illustrated by way of the following Examples. In the Examples, the zeta potential, i.e. the surface potential which is an index of electrostatic repulsive force in the solution is measured as follows.

[Measurement of Zeta Potential]

A zeta potential can generally be obtained by electrophoresis. Electrophoresis means a phenomenon wherein fine particles having surface potential migrate in a solution when electrostatic field is applied. By measuring the migration speed of the fine particles, there can be obtained the zeta potential of a particle, said the zeta potential having a proportional relation to the migration speed. In the present invention, the zeta potential of fine particles was measured by using LASER ZEE TM Model 501 (a trade name, mfd. by Pen Kem Inc.) based on this principle.

In order to confirm the effects of the present invention, resist material particles, polystyrene particles, Si particles, $SiO_2$ particles, $Si_3N_4$ particles and Fe particles were used. These particles were used only because of easily obtainable particles with almost uniform particle diameter. Thus, the effects of the present invention are, needless to say, not limited to these particles.

As the resist particles, there were used those obtained by solidifying a resist material of THMR-iP 3100 (a trade name, mfd. by Tokyo Ohka Kogyo Co., Ltd., main components: methyl-3-methoxy propionate and novolak resin) into a block and grinding it so as to have an average particle diameter (hereinafter referred to as "particle diameter") of 1 $\mu$m.

As the polystyrene particles, there were used surface modified uniform latex particles (mfd. by The Dow Chemical Company) having a particle diameter of 1 to 0.038 $\mu$m.

As the Si particles, $SiO_2$ particles, $Si_3N_4$ particles and the Fe particles, those having a particle diameter of 1 $\mu$m manufactured by High Purity Chemetals Co., Ltd. were used. As to the Si particles, there were used those not pretreated and those subjected to etching treatment for 1 minute with a hydrofluoric acid solution ($HF:H_2O$=1:99 by volume) (i.e. bare Si particles).

Experimental results showed that the values of the zeta potential was not dependent on the particle diameter. Thus, the measured data obtained by using the particles having the above-mentioned particle diameters can be applied as they are to a flat substance such as a semiconductor wafer and ultrafine particles of about 0.05 $\mu$m. Therefore, zeta potential values of semiconductor wafers covered with a resist material, $Si_3N_4$, etc. according to the present invention can be obtained from each zeta potential value of individual particles.

Table 1 shows zeta potential values of individual materials.

TABLE 1

| | Particle | | | |
|---|---|---|---|---|
| Solution | $Si_3N_4$ | Si | Resist | $SiO_2$ |
| Water | −37 | −43 | −45 | −44 |
| Hydrofluoric acid (2%) + ammonium fluoride (8%) | −34 | −23 | −40 | −23 |
| Hydrofluoric acid (0.5%) | −8 | −5 | 6 | −5 |
| Hydrochloric acid (pH 3) | −6 | −28 | 7 | −29 |
| Ammonia water (pH 9) | −93 | −53 | −56 | −60 |

(Unit : mV)

EXAMPLE 1

Figure 5:
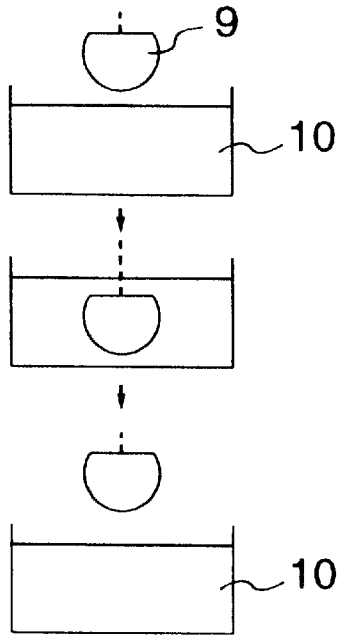
FIG. 5 is a schematic illustration showing a step of immersing a 6-inch Si wafer in a mixed aqueous solution of hydrofluoric acid and ammonium fluoride dispersing fine particles therein, and taking the Si wafer out of it.

Effects of prevention of fine particles according to the present invention were confirmed by the following steps. As shown in FIG. 5, polystyrene particles having a particle diameter of 0.038 $\mu$m were dispersed in a mixed aqueous solution obtained by using commercially available 50% hydrofluoric acid and commercially available 40% ammonium fluoride in volume ratio of $HF:NH_4F:H_2O$=1:5:19 (HF 2%, $NH_4F$ 8%) in a vessel 10 (the particle concentration in the solution was adjusted to $5\times10^5$ particles/$cm^3$). Then, a 6-inch Si wafer 9 was immersed in the solution for a predetermined time. The Si wafer was taken out of the vessel 10 and subjected to spinner drying. The amount of adhered polystyrene particles was measured by using a scanning electron microscope (SEM).

Figure 6:
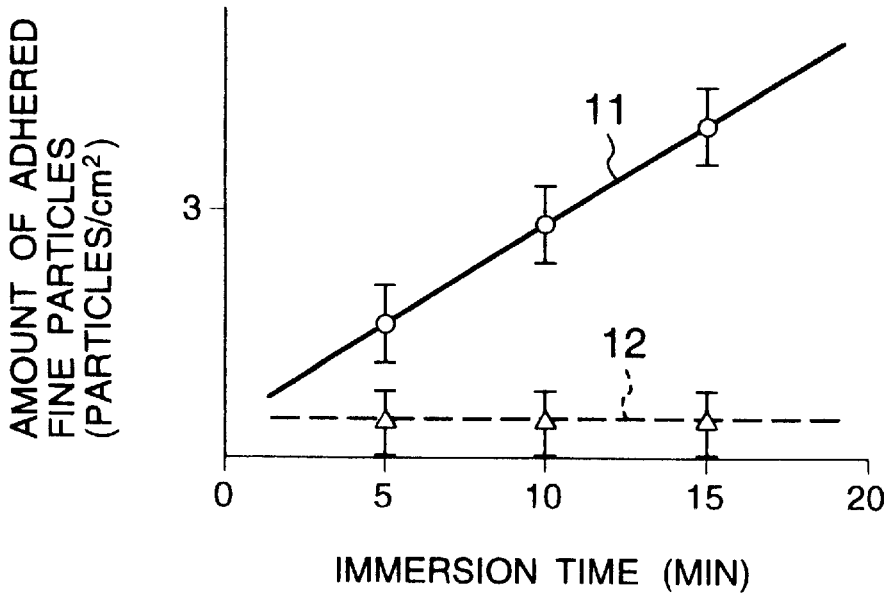
FIGS. 6 to 11 are graphs showing a relationship between the amount of adhered fine particles and the immersion time.
Figure 7:
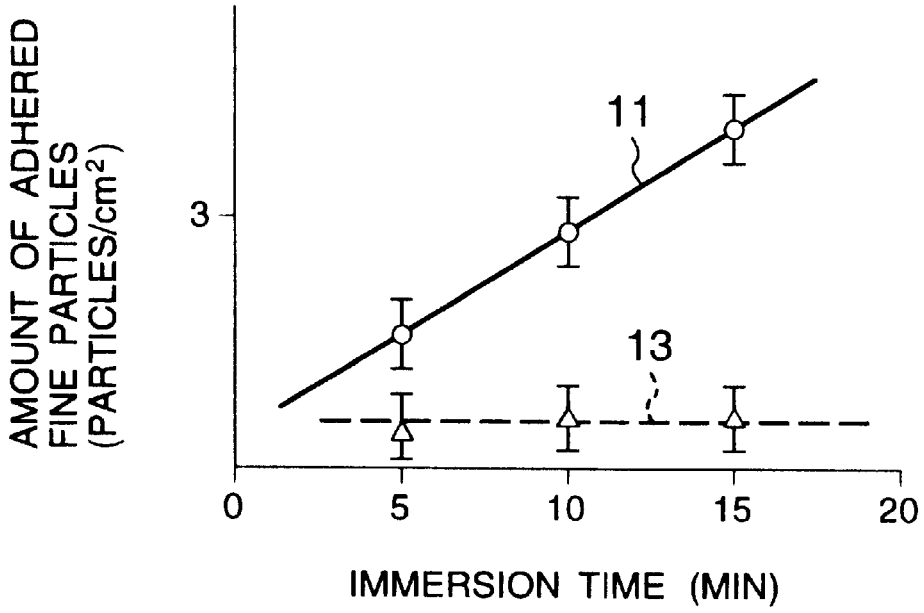

The relation between the immersing time and the amount of adhered polystyrene particles was shown by the line 11 in FIGS. 6 and 7. As is clear from these results, the adhered amount increases with an increase of the immersion time.

In the same manner as mentioned above, a Si wafer covered with the resist material was tested to measure adhered polystyrene particles. The results are shown by the line 12 in FIG. 6. As is clear from FIG. 6, almost no adhesion of polystyrene particles was admitted.

When a Si wafer covered with $Si_3N_4$ was also tested in the same manner as mentioned above. The results are shown by the line 13 in FIG. 7. As is clear from FIG. 7, almost no adhesion of polystyrene particles was admitted.

As is clear from the above results, the amount of adhered fine particles to the Si wafer can be reduced remarkably by covering the Si wafer (substrate) with the resist material or the $Si_3N_4$.

As the resist material, there can be used photosensitive resins. Examples of the photosensitive resins are novolak resins, cyclized natural rubbers, cyclized synthetic rubbers, polyvinyl cinnamate, poly(methyl isopropenyl ketone), polyvinyl phenol, photosensitive polyimides, polyvinyl-p-azidobenzoate, polymethacryloyl oxybenzal acetophenone, polyvinyl cinnamylidene acetate, poly(methyl methacrylate), 4,4'-diazidodiphenyl sulfide, poly-4-vinyl phenol, 3,3'-diazidodiphenylsulfone, chloromethylated polystyrene, styrenated polymers bound to 2,4-dichlorobenzoic acid derivatives, chlorinated styrene polymers, hexafluorobutyl methacrylate polymers, tetrafluoropropyl methacrylate polymers, naphthoquinone diazide compound, methyl methacrylate-acrylonitrile copolymer, poly(glycidyl methacrylate), poly(2-methyl-1-pentene sulfone), iodinated polystyrene, poly($\alpha$-cyano acrylate), poly(hexafluorobutyl methacrylate), poly (dimethyltetrafluoropropyl methacrylate), poly (trichloroethyl methacrylate), poly(trifluoroethyl-$\alpha$-chloroacrylate), polymethacrylates introducing methyl maleate into side chain(s), chlorinated polymethylsulfone, novolak-benzoquinone diazide, trichloroethyl methacrylate polymer, trifluoroethyl chloroacrylate polymer, polymethacrylates, ethyl acrylate copolymers, and sulfone copolymers. These resins can be used singly or as a mixture thereof. Particularly, novolak resins, cyclized natural rubbers, cyclized synthetic rubbers, and polyvinyl cinnamate are preferable due to excellent resistance to hydrofluoric acid.

As the photosensitive agent, there can be used o-naphthodiazide compounds, bisazide compounds, conventional sensitizers such as amines, amides, etc., $\alpha$-naphthoquinone diazide compounds, 4-azide chalcone, etc.

As the film effective for preventing adhesion of fine particles, there can be used other conventional organic films. As the organic materials constituting such organic films, there can be used those having one or more polar groups, one or more hydroxyl groups (—OH), one or more ester linkages (—COO—), one or more acid amide linkages (—CONH—), and one or more ether linkages (—O—), for example, 2-aminoethanol, 2-propanol, etc. Further, this film can be a film having electrostatic repulsive force obtained by surface treatment such as irradiation with ultraviolet rays, etc.

As the cleaning solution, there can be used the following (A) to (F):

(A) an acidic solution containing at least one of hydrofluoric acid, hydrochloric acid, sulfuric acid, nitric acid, acetic acid, and conventionally used organic acids, (B) an acidic solution comprising an inorganic or organic acid, hydrogen peroxide solution, and ammonium fluoride, (C) an alkaline solution comprising at least one member selected from the group consisting of ammonia water and amines, (D) an alkaline solution comprising at least one of ammonia water and amines, and hydrogen peroxide solution and ammonum fluoride, (E) a mixture comprising at least one of the acidic solutions of (A) and (B), and at least one of the alkaline solutions of (C) and (D), and (F) a neutral solution, such as ultra-pure water.

As the acidic solution, that having a pH of 1 to 4 is particularly preferable due to excellent effect for preventing adhesion of fine particles, particularly in the case of using ammonium fluoride.

The cleaning solution may further contain one or more cationic surfactants, anionic surfactants, ampholytic surfactants, organic solvents, such as 2-aminoethanol, 2-propanol, etc.

The material to be covered (i.e. a substrate) can be materials used for various semiconductor devices such as Si, poly Si, as well as metals, alloys, ceramics, and the like inorganic or organic materials. The material to be covered can take any forms such as not only flat plates, but also sphericals, blocks, and various complicated shapes. Further, the size of the material to be covered can be from very fine size such as ultrafine particles to very large size.

EXAMPLE 2

Using a commercially available 50% hydrofluoric acid and 40% ammonium fluoride, there was obtained a mixed aqueous solution of hydrofluoric acid and ammonium fluoride ($HF:NH_4F:H_2O$=1:5:35 by volume; HF 1.25%, and $NH_4F$ 5%), into which Si particles having a particle diameter of 1 $\mu$m were dispersed (the particle concentration was adjusted to $5\times10^7$ particles/cm$^3$). A 6-inch Si wafer was used in the same manner as described in Example 1 to conduct the experiment of adhesion of Si particles to the wafer. The amount of adhered fine particles was measured by using a wafer inspection system (Surfscan 3000, a trade name, mfd. by TENCOR INSTRUMENTS Inc., measurable particle diameter 0.3 $\mu$m or more).

Figure 8:
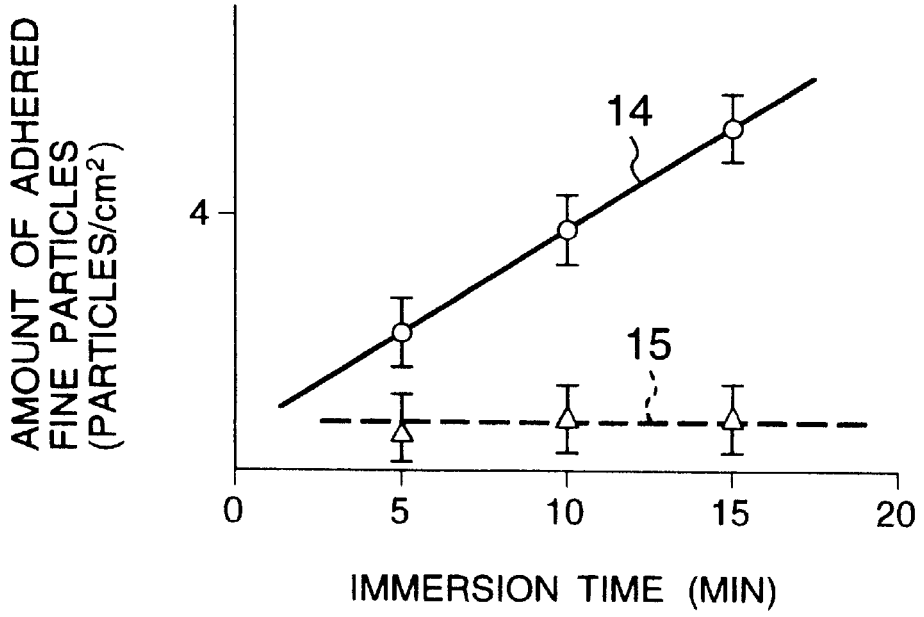

The results are shown by the line 14 in FIG. 8. As is clear from FIG. 8, the adhered amount increases with an increase of the immersion time.

Further, using a Si wafer covered with $Si_3N_4$, the Si particles adhesion experiment was conducted under the same conditions as mentioned above. The results are shown by the line 15 in FIG. 8.

As a result of this experiment, it was found that almost no adhesion of Si particles was observed.

EXAMPLE 3

The same mixed aqueous solution of hydrofluoric acid and ammonium fluoride as Example 2 was adjusted. To this, bare Si particles having a particle diameter of 1 $\mu$m were dispersed (the particle concentration was adjusted to $5\times10^7$ particles/cm$^3$). Using a 6-inch Si wafer 9, the adhesion experiment was conducted in the same manner as described in Example 2.

Figure 9:
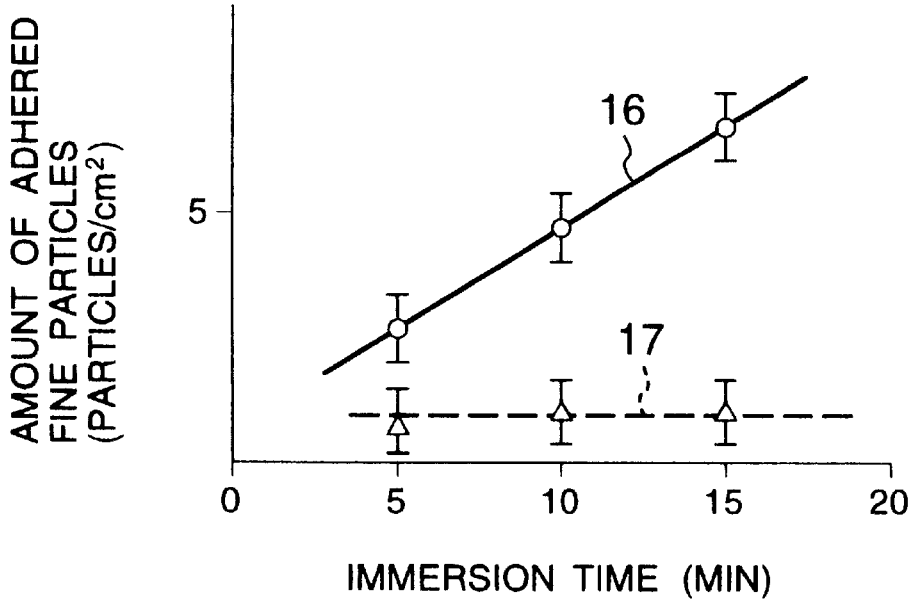

The results are shown by the line 16 in FIG. 9. From these results, it was found that the adhered amount of bare Si particles increased with an increase of the immersion time.

Then, using a Si wafer covered with the resist material, the Si particles adhesion experiment was carried out under the same conditions as mentioned above.

The results are shown by the line 17 in FIG. 9. As shown in FIG. 9, adhesion of the bare Si particles to the Si wafer covered with the resist material was hardly observed.

EXAMPLE 4

The same mixed aqueous solution of hydrofluoric acid and ammonium fluoride as Example 2 was adjusted. To this, $SiO_2$ particles having a particle diameter of 1 $\mu$m were dispersed (the particle concentration was adjusted to $5\times10^7$ particles/cm$^3$). Using a 6-inch Si wafer, the adhesion experiment was conducted in the same manner as described in Example 2.

Figure 10:
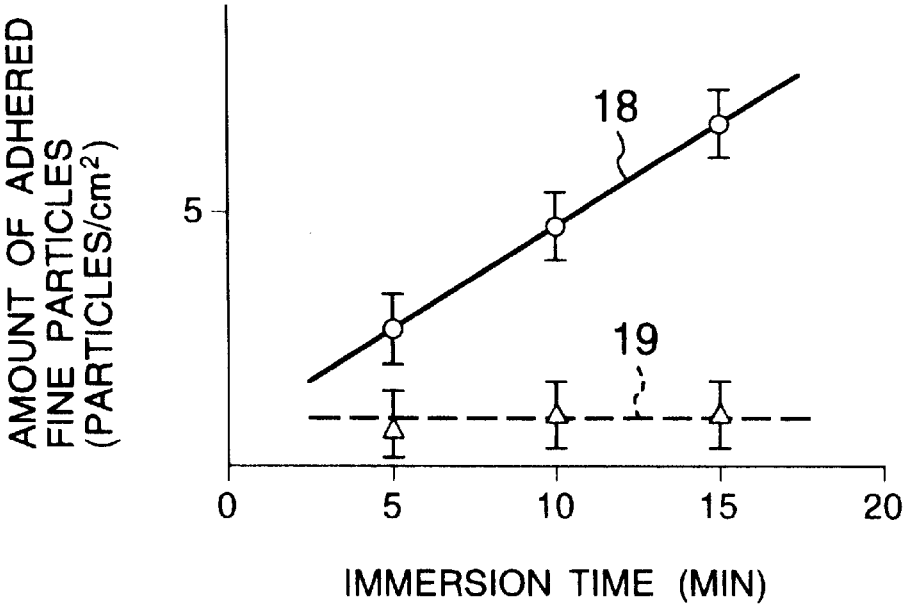

The results are shown by the line 18 in FIG. 10. From these results, it was found that the adhered amount of Si particles increased with an increase of the immersion time.

Then, using a Si wafer covered with the resist material, the $SiO_2$ particles adhesion experiment was carried out under the same conditions as mentioned above.

The results are shown by the line 19 in FIG. 10. As shown in FIG. 10, adhesion of $SiO_2$ particles to the Si wafer covered with the resist material was hardly observed.

EXAMPLE 5

In a mixed aqueous solution of hydrofluoric acid and ammonium fluoride adjusted in the same manner as described in Example 2, Fe particles having a particle diameter of 1 $\mu$m were dispersed (the particle concentration was adjusted to $5\times10^7$ particles/cm$^3$). Using a 6-inch Si wafer, the adhesion experiment was conducted in the same manner as described in Example 2.

Figure 11:
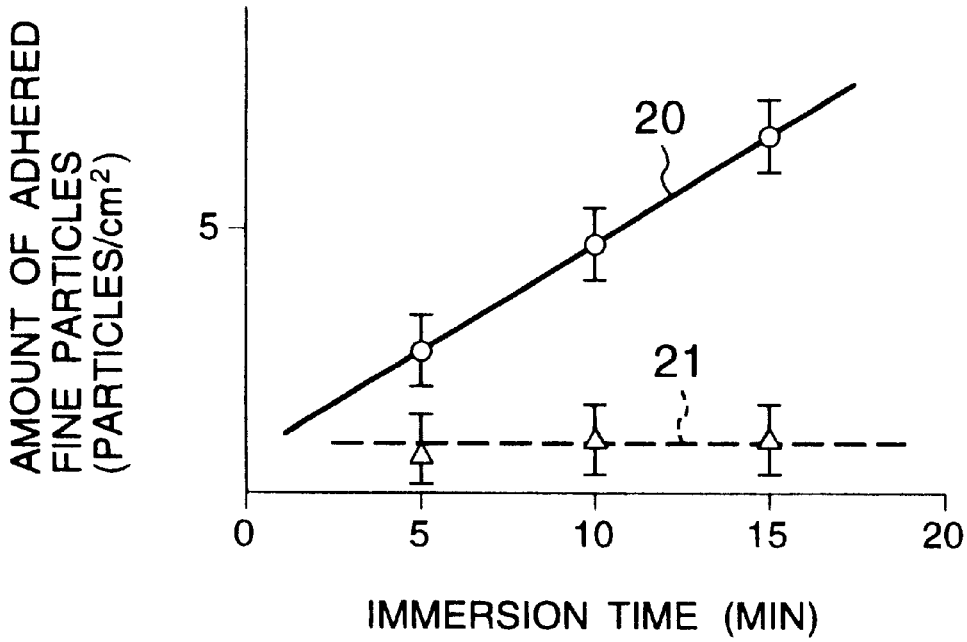

The results are shown by the line 20 in FIG. 11. From these results, it was found that the adhered amount of Fe particles increased with an increase of the immersion time.

Then, using a Si wafer covered with the resist material, the Fe particles adhesion experiment was carried out under the same conditions as mentioned above.

The results are shown by the line 21 in FIG. 11. As shown in FIG. 11, adhesion of Fe particles to the Si wafer covered with the resist material was hardly observed.

EXAMPLE 6

Figure 12:
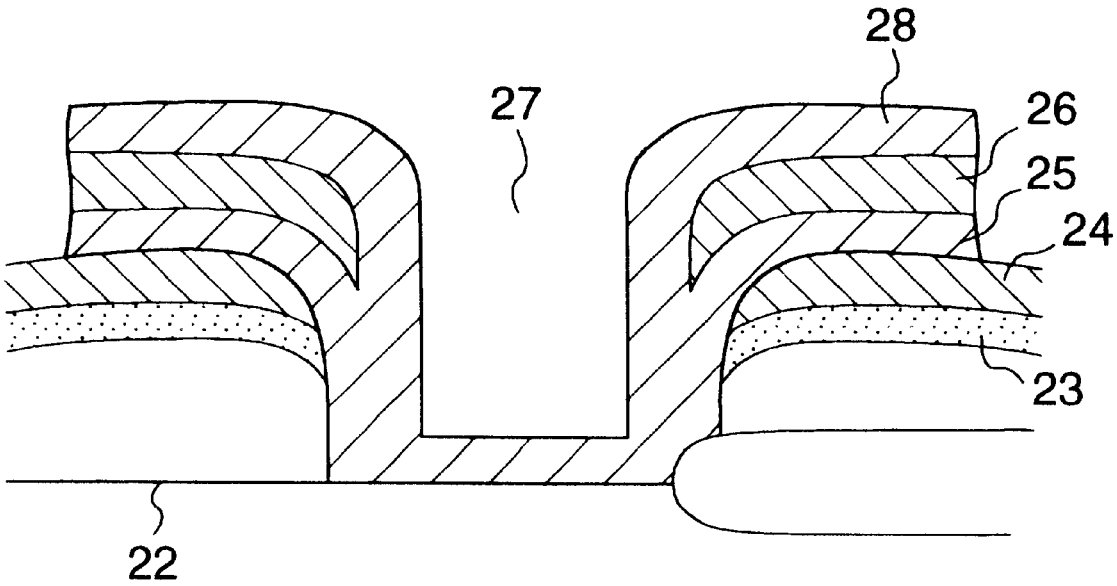
FIG. 12 PRIOR ART
FIG. 12 is a cross-sectional view of a fin structure capacitor portion of a prior art semiconductor product wafer.

As to the prevention of adhesion of fine particles generated from a prior art product produced by a semiconductor production line, the same experiment as described in Example 2 was carried out. The prior art product used in this experiment was a wafer formed thereon a semiconductor element having a stacked fin structure (see T. Ema et al, IEDM Tech. Dig. pp. 592–594, 1988) (hereinafter referred to as "a semiconductor product wafer"). FIG. 12 is a cross-sectional view of the prior art product of a fin structure capacitor portion.

Figure 13:
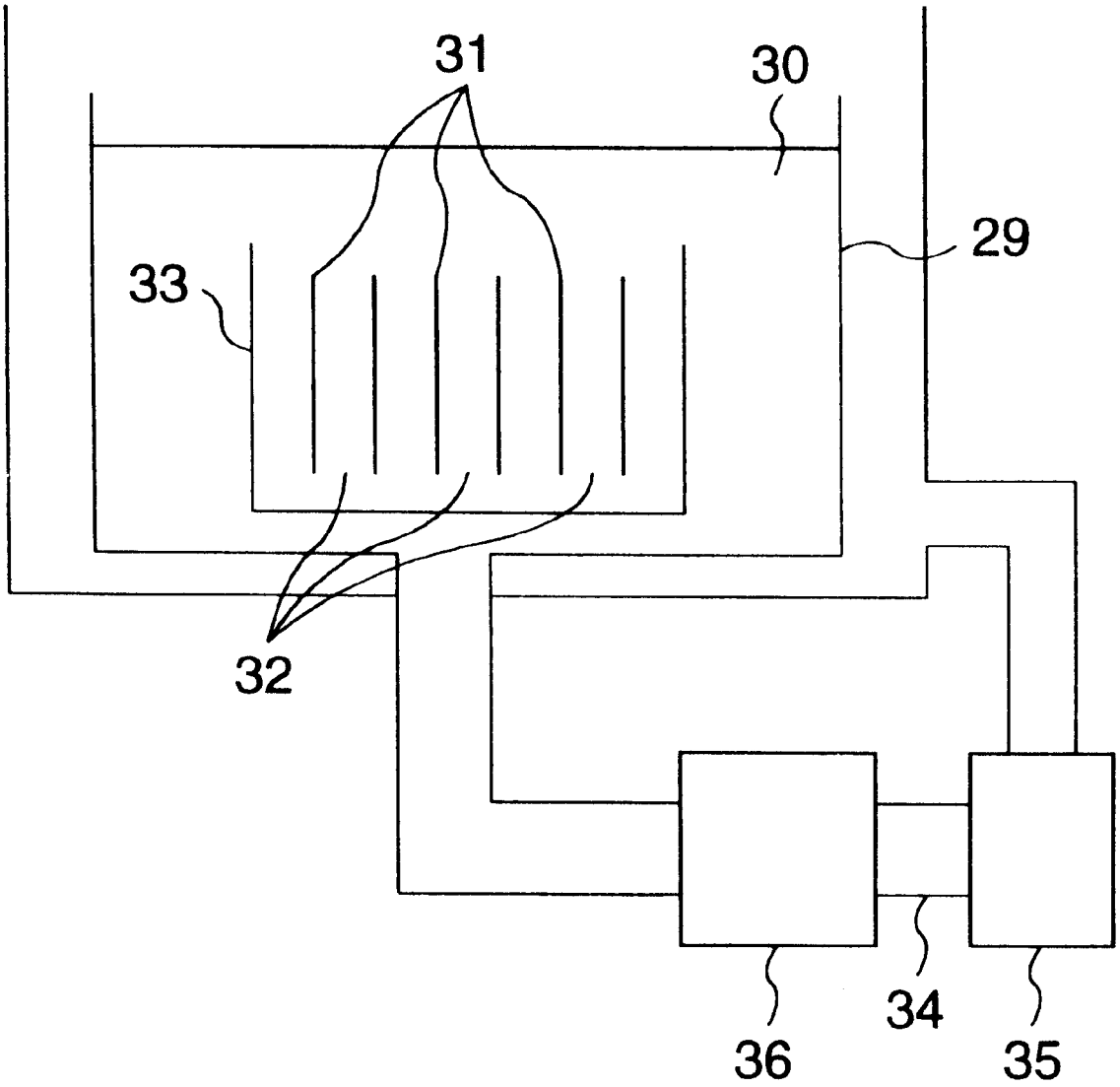
FIG. 13 is a flow diagram explaining immersing in a mixed aqueous solution of hydrofluoric acid and ammonium fluoride and taking various wafers out of it.

The experiment was carried out using an overflow type etching tank 29 shown in FIG. 13, the tank 29 being filled with the same mixed aqueous solution as used in Example 2. As shown in FIG. 13, the pipe 34 for circulating the solution has a circulating pump 35, from which the solution is flowed out and cleaned by a filter 36 and returns to the etching tank 29 again. In the etching tank 29, a plurality of semiconductor product wafers 31 shown in FIG. 12 and a plurality of wafers 32 for measuring the amount of adhered fine particles such as Si wafers covered with natural oxide film, Si wafers uniformly covered with $Si_3N_4$ (film thickness 0.03 $\mu$m) or the resist material (film thickness 1 $\mu$m) were installed in a wafer cassette and immersed in the mixed aqueous solution for 10 minutes. Then, individual wafers 32 for measuring the amount of adhered fine particles were picked up from the etching tank 29, followed by washing with water and drying using a spinner. Then, the amount of adhered fine particles to individual wafers was measured using a wafer inspection system. The results are shown in Table 2.

TABLE 2

| Item | Water Surface $Si_3N_4$ | Si | Resist |
|---|---|---|---|
| Amount of adhered fine particles (particles/$cm^2$) | 0.06–0.09 | 1.1–2.5 | 0.03–0.1 |

As is clear from Table 2, the amounts of adhered fine particles to the wafers covered wholly with the $Si_3N_4$ or covered with the uniform resist material film are one order or more as small as that of the wafer covered with the natural oxide film.

EXAMPLE 7

Using semiconductor product wafers, the experiment was carried out in the same manner as described in Example 6, except for using a mixed aqueous solution obtained by using commercially available 50% hydrofluoric acid and 40% ammonium fluoride in volume ratios of $HF:NH_4F:H_2O$= 1:5:19. The results are shown in Table 3.

TABLE 3

| Item | Water Surface $Si_3N_4$ | Si | Resist |
|---|---|---|---|
| Amount of adhered fine particles (particles/$cm^2$) | 0.05–0.2 | 1.0–1.8 | 0.05–0.1 |

As shown in Table 3, the Si wafers wholly covered with the $Si_3N_4$ or covered with the uniform resist film show very reduced amounts of adhered fine particles compared with the Si wafer covered with the natural oxide film as in Example 6.

EXAMPLE 8

Figure 14A:
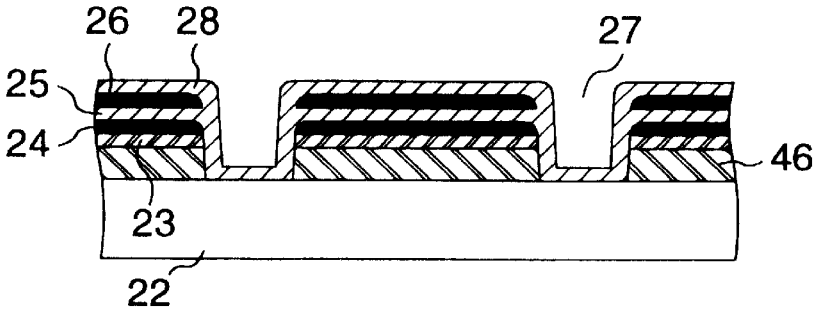
FIG. 14A PRIOR ART
FIGS. 14A to 14E are cross-sectional views showing each step for producing a fin structure capacitor portion of a semiconductor product wafer according to a prior art technique.
Figure 14B:
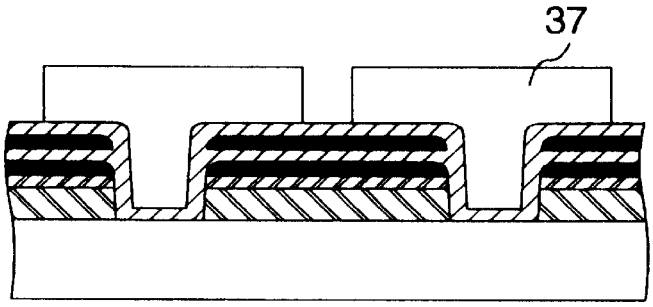
FIG. 14B PRIOR ART
Figure 14C:
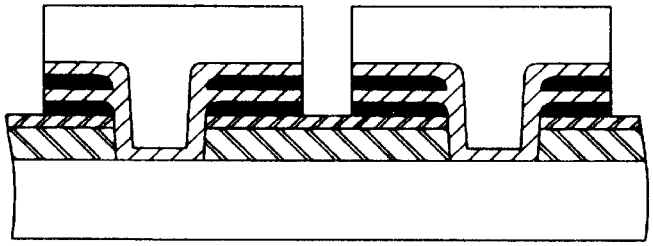
FIG. 14C PRIOR ART

Processes for producing semiconductor product wafers having a fin structure capacitor portion are explained referring to FIGS. 14A to 14E and FIGS. 15A to 15D. After forming transistor on a semiconductor substrate 22 (FIG. 14A), a $Si_3N_4$ film 23 (film thickness 0.05–0.1 $\mu$m) is grown on a $SiO_2$ film 46. Then, a $SiO_2$ film 24 (film thickness, about 0.1 $\mu$m), a poly Si film 25 and a $SiO_2$ film 26 (film thickness, about 0.1 $\mu$m) are grown one after another and a contact hall 27 (diameter, about 0.5 $\mu$m) is formed. After this, a poly Si film 28 is grown on the whole surface (FIG. 14A). After forming a pattern-like resist 37 (FIG. 14B), the poly Si film 25 and the $SiO_2$ film 26 are subjected to dry etching for patterning using the resist as a mask and the $Si_3N_4$ film as a stopper (FIG. 14C). The above-mentioned steps are disclosed in the reference by T. Ema et al mentioned above, and the like.

Figure 14D:
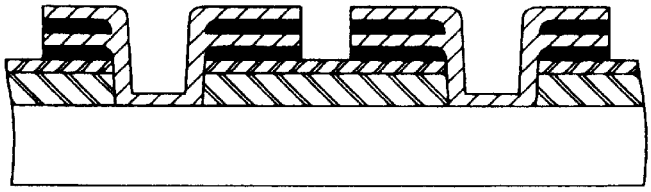
FIG. 14D PRIOR ART
Figure 14E:
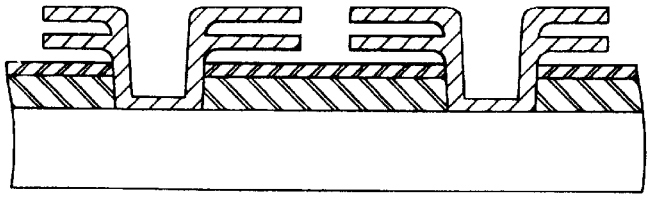
FIG. 14E PRIOR ART

According to the prior art, after the steps of FIG. 14A to 14C, the resist 37 was removed as shown in FIG. 14D, followed by removal of the $SiO_2$ films 24 and 26 by wet etching to form the fin structure (FIG. 14E) as disclosed, for example, in JP-A 4-30464.

Figure 15A:
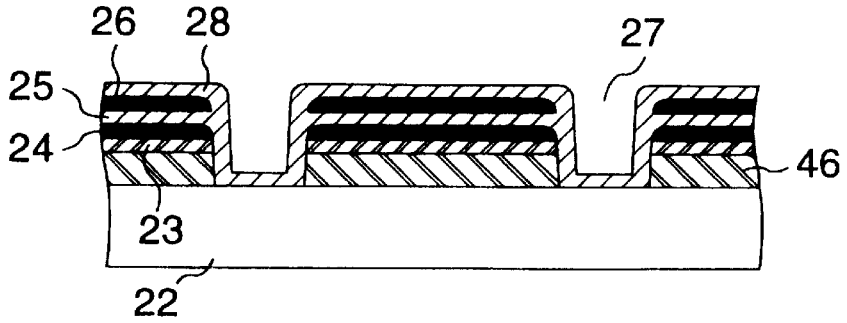
FIGS. 15A to 15D are cross-sectional views showing each step for producing a fin structure capacitor portion of a semiconductor product wafer according to the present invention.
Figure 15B:
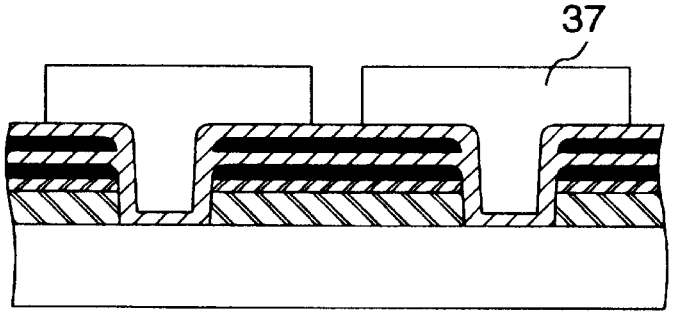
Figure 15C:
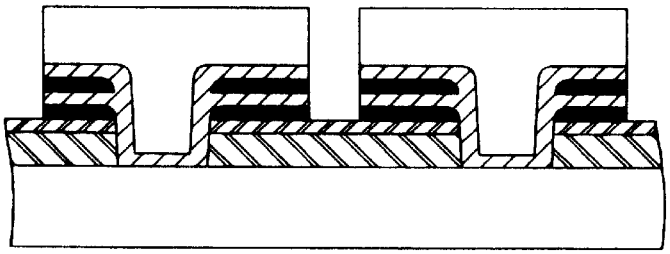
Figure 15D:
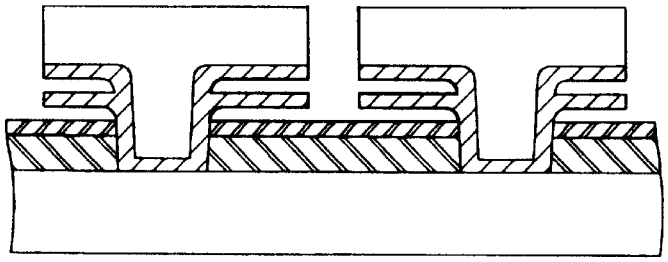
Figure 16:
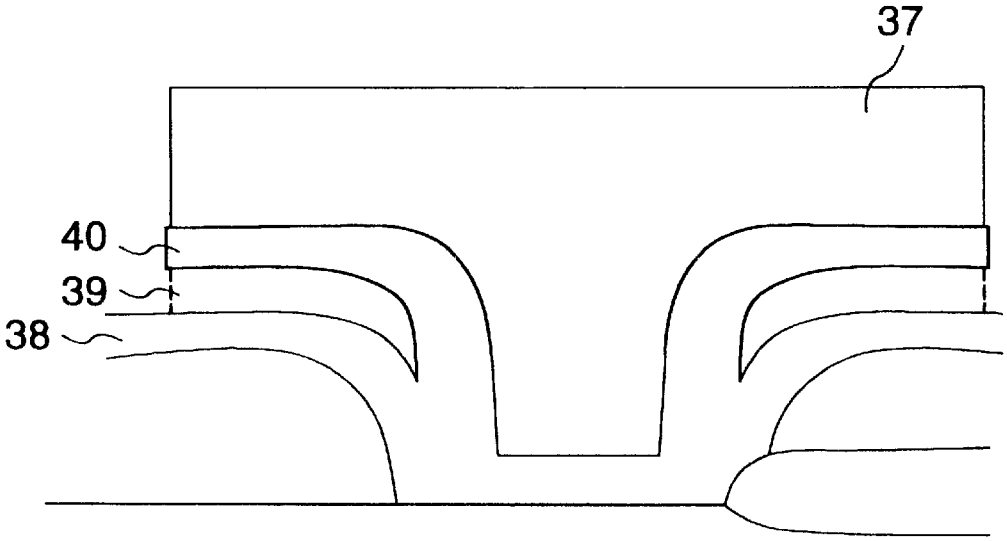
FIG. 16 PRIOR ART
FIG. 16 is a cross-sectional view of a fin structure capacitor portion of a semiconductor product wafer according to prior art.

In contrast, according to the present invention, at the state shown in FIG. 15C, which is obtained by the same steps as shown in FIG. 14A to FIG. 14C, the $SiO_2$ films 24 and 26 are removed by etching while retaining the resist 37 (FIG. 15D). In the production process shown in FIGS. 14D and 14E wherein etching was carried out after removal of the resist, fine particles were adhered to the exposed poly Si surface 28. But, as shown in FIG. 15D, when etching was carried out while retaining the resist 37, the adhesion of fine particles to the resist surface 37 was small and the adhesion of fine particles to the exposed $Si_3N_4$ film 23 after etching of the $SiO_2$ film 24 was also small.

When the amount of adhered fine particles on the products was measured (using a wafer inspection system, Model KLA-2111, a trade name, mfd. by KLA Co. for measuring fine particles having a particle diameter of 0.3 $\mu$m or more on the surface of the semiconductor element), 0.9 particle/$cm^2$ in average was obtained as to the prior art process, while 0.2 particle/$cm^2$ or less was obtained as to the process of the present invention. These results are shown in Table 4.

TABLE 4

| Item | Semiconductor product wafer Prior art | The present invention |
|---|---|---|
| Amount of adhered fine particles (particles/$cm^2$) | 0.5–1.5 | 0–0.2 |

Adhesion of fine particles to surfaces wherein the poly Si film 25 and the poly Si film 28 not covered by the resist 37 were faced each other as shown in FIG. 15C, is explained below.

The size of fine particles generated during wet etching of semiconductor product wafers shown in FIGS. 14 and 15 is almost 0.1 $\mu$m or more. On the other hand, the distance between the surfaces of the poly Si film 25 and the poly Si film 28 not covered with the resist 37 and faced each other shown in FIG. 15C is about 0.1 $\mu$m. Therefore, the above-mentioned fine particles having a larger particle diameter cannot enter into the faced distance, resulting in causing no problem of adhesion of fine particles to the poly Si film 25 and the poly Si film 28.

Therefore, this Example is characterized by exposing the $Si_3N_4$ surface which is hardly subjected to adhesion of fine particles at the finish of etching, and effective for reducing the adhesion of fine particles to the product by co-use of the resist surface. In this Example, the solution used for wet etching can function as a cleaning solution. But apart from this, it is possible to use another cleaning solution other than the solution used for wet etching for immersing the wafer after conducting wet etching.

EXAMPLE 9

A semiconductor product wafer produced by the process shown in FIGS. 14A to 14E and a semiconductor product wafer produced by the process shown in FIGS. 15A to 15D according to the present invention were subjected to oxide film etching treatment one after another using a mixed aqueous solution of hydrofluoric acid and ammonium fluoride. The amount of adhered fine particles was measured in the same manner as described in Example 8. The results are shown in Table 5.

TABLE 5

| Item | Semiconductor product wafer | |
|---|---|---|
| | Prior art | The present invention |
| Amount of adhered fine particles (particles/cm$^2$) | 0.1–0.5 | 0–0.2 |

As shown in Table 5, the amount of adhered fine particles to the semiconductor product wafer according to the present invention was very small.

EXAMPLE 10

In the overflow type etching tank shown in FIG. 13, the mixed aqueous solution used in Example 2 was placed. After immersing the same semiconductor product wafer as shown in FIG. 12 for 10 minutes, the amount of adhered fine particles was measured in the same manner as described in Example 8.

Then, a semiconductor product wafer as shown in FIG. 12 was coated with an anionic surfactant on the whole surface except for peripheral 5 mm wide area. The resulting wafer was subjected to the same experiment as mentioned above. The results are shown in Table 6.

TABLE 6

| Item | Semiconductor product wafer | |
|---|---|---|
| | Prior art | The present invention |
| Amount of adhered fine particles (particles/cm$^2$) | 0.5–1.5 | 0.1–0.3 |

As shown in Table 6, the adhesion of fine particles to the semiconductor product wafer coated with the anionic surfactant according to the present invention was hardly admitted.

EXAMPLE 11

Figure 17:
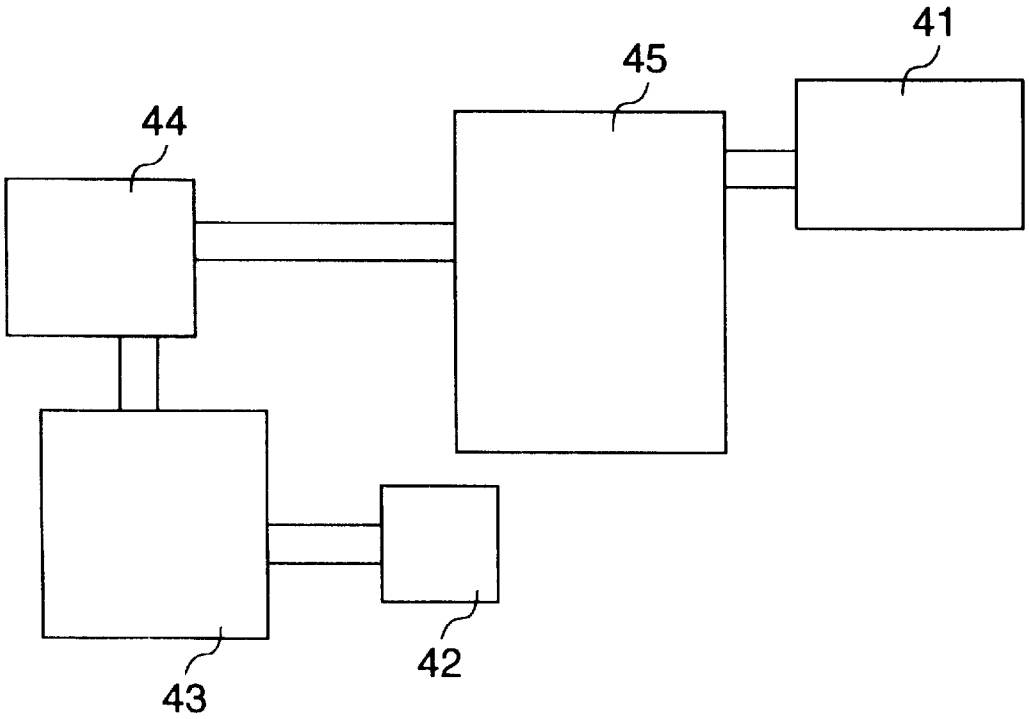
FIG. 17 is a schematic diagram showing a cleaning system according to the present invention.

One example of cleaning system for practicing the present invention is shown in FIG. 17. In FIG. 17, a substance having electrostatic repulsive force supplied from a storing section 42 of the substance having electrostatic repulsive force is coated on a semi-conductor product wafer by a coating device 43, and using a Si wafer transporting system 44 the coated Si wafer is transported to a cleaning tank 45, wherein the semiconductor product wafer is cleaned with a cleaning solution or an etching solution supplied from an adjusting section 41 for the cleaning solution or the etching solution.

As mentioned above, according to the present invention, since the adhesion of fine particles in a cleaning solution or etching solution can be prevented or reduced remarkably, electronic parts such as semi-conductor devices, thin film devices, dises, etc. can be produced in higher field with lower cost without undesirable adhesion of fine particles.

What is claimed is:

1. A cleaning method which comprises:

a step of forming on a substrate a first film of a material which has a smaller electrostatic repulsive force against fine particles, in a cleaning solution, than that of single crystal silicon, a step of forming a second film having electrostatic repulsive force against the fine particles so as to cover the first film, and a step of cleaning the substrate covered with the second film using the cleaning solution containing fine particles, the second film being formed to cover the first film prior to contacting the covered substrate with the cleaning solution.

2. A cleaning method which comprises:

a step of forming an aluminum film on a substrate, a step of forming a second film having electrostatic repulsive force against fine particles present in a cleaning solution so as not to expose the aluminum film, and a step of cleaning the substrate covered with the second film using the cleaning solution, the second film being formed to cover the aluminum film prior to contacting the covered substrate with the cleaning solution.

3. A cleaning method which comprises:

a step of forming a polysilicon film on a substrate, a step of forming a second film having electrostatic repulsive force against fine particles present in a cleaning solution so as not to expose the polysilicon film, and a step of cleaning the substrate covered with the second film using the cleaning solution, the second film being formed to cover the polysilicon film prior to contacting the covered substrate with the cleaning solution.

4. A cleaning method which comprises:

a step of forming on a substrate a first film of a material which has a smaller electrostatic repulsive force against fine particles, in a cleaning solution, than that of single crystal silicon, a step of forming two or more films having electrostatic repulsive force against the fine particles so as not to expose the first film, and a step of cleaning the substrate covered with the two or more films by immersing the substrate in the cleaning solution, the two or more films being formed prior to immersing the substrate in the cleaning solution.

5. A cleaning method which comprises:

a step of forming on a substrate a first film of a material which has a smaller electrostatic repulsive force against fine particles, in a cleaning solution, than that of single crystal silicon, a step of forming a second film of at least one member selected from the group consisting of a resist, $Si_3N_4$ and $SiO_2$ so as not to expose the first film, and a step of cleaning the substrate covered with the second film using the cleaning solution containing fine particles, the second film being formed to cover the first film prior to contacting the covered substrate with the cleaning solution.

6. A cleaning method according to claim 5, wherein the second film includes the resist, and wherein the resist is a photosensitive resin including at least one member selected from the group consisting of novolak resins, cyclized natural rubbers, cyclized synthetic rubbers, polyvinyl cinnamate, poly(methyl isopropenyl ketone), polyvinyl phenol, photosensitive polyimides, polyvinyl-p-azidobenzoate, polymethacryloyl oxybenzal acetophenone, polyvinyl cinnamylidene acetate, poly(methyl methacrylate), 4,4'-diazidodiphenyl sulfide, poly-4-vinyl phenol, 3,3'-diazidodiphenylsulfone, chloromethylated polystyrene, styrenated polymers bound to 2,4-dichlorobenzoic acid derivatives, chlorinated styrene polymers, hexafluorobutyl methacrylate polymers, tetrafluoropropyl methacrylate polymers, naphthoquinone diazide compound, methyl methacrylate-acrylonitrile copolymer, poly(glycidyl methacrylate), poly(2-methyl-1-pentene sulfone), iodinated polystyrene, poly(α-cyano acrylate), poly(hexafluorobutyl methacrylate), poly(dimethyl tetrafluoropropyl methacrylate), poly(trichloroethyl methacrylate), poly (trifluoroethyl-α-chloroacrylate), polymethacrylates introducing methyl maleate into side chain(s), chlorinated polymethylsulfone, novolak-benzoquinone diazide, trichloroethyl methacrylate polymer, trifluoroethyl chloroacrylate polymer, polymethacrylates, ethyl acrylate copolymers, and sulfone copolymers.

7. A cleaning method according to claim 5, wherein the resist includes as a photosensitive agent, at least one member selected from the group consisting of o-naphthodiazide compounds, bisazide compounds, sensitizers, α-naphthoquinone diazide compounds, and 4-azide chalcone.

8. A cleaning method which comprises:

a step of forming an aluminum film on a substrate, a step of forming a second film of at least one member selected from the group consisting of a resist, $Si_3N_4$ and $SiO_2$ so as not to expose the first film, and a step of cleaning the substrate covered with the second film using a cleaning solution, the second film being formed to cover the aluminum film prior to contacting the covered substrate with the cleaning solution.

9. A cleaning method which comprises:

a step of forming a polysilicon film on a substrate, a step of forming a second film of at least one member selected from the group consisting of a resist, $Si_3N_4$ and $SiO_2$ so as to cover the polysilicon film, and a step of cleaning the substrate covered with the second film using a cleaning solution, the second film being formed to cover the polysilicon film prior to contacting the covered substrate with the cleaning solution.

10. A cleaning method which comprises:

a step of forming on a substrate a first film of a material which has a smaller electrostatic repulsive force against fine particles, in a cleaning solution, than that of single crystal silicon, a step of forming an organic film so as not to expose the first film, and a step of cleaning the substrate covered with the organic film using the cleaning solution, the organic film being formed on the first film prior to contacting the covered substrate with the cleaning solution in the cleaning step.

11. A cleaning method according to claim 10, wherein the first film is an aluminum film or a polysilicon film.

12. A cleaning method according to claim 10, wherein the organic film has one or more polar groups.

13. A cleaning method according to claim 10, wherein the organic film has a least one member selected from the group consisting of a hydroxyl group, an ester linkage, an acid-amide linkage and an ether linkage.

14. A cleaning method which comprises:

cleaning a substrate on which a film having a zeta potential of 25 mV or more in an absolute value in a cleaning solution has been formed, by immersing the substrate in the cleaning solution, said cleaning solution being one member selected from the group consisting of (A) an acidic solution containing at least one of hydrofluoric acid, hydrochloric acid, sulfuric acid, nitric acid, acetic acid, and organic acids, (B) an acidic solution comprising an inorganic or organic acid, hydrogen peroxide solution, and ammonium fluoride, (C) an alkaline solution comprising at least one member selected from the group consisting of ammonia water and amines, (D) an alkaline solution comprising at least one of ammonia water and amines, and hydrogen peroxide solution and ammonum fluoride, (E) a mixture comprising at least one of the acidic solutions of (A) and (B), and at least one of the alkaline solutions of (C) and (D), and (F) a neutral solution.

15. A cleaning method which comprises:

forming a film on a substrate, so as to cover the substrate; and cleaning the substrate on which the film has been formed, by immersing the covered substrate in a cleaning solution, the film having been formed on the substrate prior to immersing the covered substrate in the cleaning solution, the film having a zeta potential of 25 mV or more in an absolute value in the cleaning solution, said cleaning solution being one member selected from the group consisting of (A) an acidic solution containing at least one of hydrofluoric acid, hydrochloric acid, sulfuric acid, nitric acid, acetic acid, and organic acids, (B) an acidic solution comprising an inorganic or organic acid, hydrogen peroxide solution, and ammonium fluoride, (C) an alkaline solution comprising at least one member selected from the group consisting of ammonia water and amines, (D) an alkaline solution comprising at least one of ammonia water and amines, and hydrogen peroxide solution and ammonium fluoride, (E) a mixture comprising at least one of the acidic solutions of (A) and (B), and at least one of the alkaline solutions of (C) and (D), and (F) a neutral solution.

16. A cleaning method which comprises:

a step of forming on a substrate a first film of a material which has a smaller electrostatic repulsive force against fine particles, in a cleaning solution, than that of single crystal silicon, a step of forming a second film, having electrostatic repulsive force against the fine particles present in the cleaning solution, so as to cover the first film, and a step of cleaning the substrate covered with the second film using the cleaning solution, the cleaning solution having a pH of 1 to 4, the second film being formed to cover the first film prior to contacting the covered substrate with the cleaning solution.

17. A cleaning method which comprises:

forming a film on a substrate, so as to cover the substrate; and cleaning the substrate on which the film has been formed, by contacting the covered substrate with a cleaning solution, the film having been formed on the substrate prior to contacting the covered substrate with the cleaning solution, the film having a zeta potential of 25 mV or more in an absolute value in the cleaning solution, the cleaning solution having a pH of 1 to 4.

18. A cleaning method which comprises:

forming a film, having electrostatic repulsive force against fine particles present in a cleaning solution, on a substrate, so as not to expose the substrate, and cleaning the substrate by immersing the substrate in the cleaning solution, the film being formed on the substrate prior to immersing the substrate in the cleaning solution.

19. A process for producing a semiconductor device which comprises:

a step of forming on a substrate a first film of a material which has a smaller electrostatic repulsive force against fine particles, in a cleaning solution, than that of single crystal silicon, a step of forming a second film, having electrostatic repulsive force against the fine particles, on the first film, a step of forming a third film on the second film, a step of forming a resist film having a desired form on the third film, a step of dry etching the third film using the resist film as a mask and the second film as a stopper, and a step of immersing the substrate having the resist film previously formed thereon, in the cleaning solution, the resist film maintained on the substrate when the substrate is immersed in the cleaning solution.

20. A process for producing a semiconductor device which comprises:

a step of forming a first film having a zeta potential of 25 mV or more in an absolute value in a solution, on a substrate, a step of forming a second film, having electrostatic repulsive force against fine particles present in the solution, on the first film, a step of forming a third film on the second film, a step of forming a resist film having a desired form on the third film, a step of dry etching the third film using the resist film as a mask and the second film as a stopper, and a step of immersing the substrate having the resist film previously formed thereon in the solution, the resist film maintained on the substrate when the substrate is immersed in the solution.

21. A process for producing a semiconductor device which comprises:

a step of forming a first film of a material which has a smaller electrostatic repulsive force against fine particles, in a cleaning solution, than that of single crystal silicon, on a substrate, a step of forming a second film on the first film, a step of forming a laminated film comprising a third film and a polysilicon film on the second film, a step of forming a resist film on the laminated film, a step of dry etching the laminated film using the resist film as a mask and the second film as a stopper, and a step of wet etching the third film while immersing the substrate having the resist film previously formed thereon in a solution, the resist film maintained on the substrate when the substrate is immersed in the solution.

22. A cleaning method which comprises:

forming a film on a substrate, so as to cover the substrate; and after forming said film on said substrate, contacting the covered substrate with a cleaning solution so as to clean the covered substrate, wherein said film has a zeta potential of 25 mV or more in absolute value in said cleaning solution.

23. A cleaning method according to claim 4, wherein the cleaning solution contains the fine particles, the two or more films avoiding exposure of the first film to the fine particles in the cleaning solution.

24. A cleaning method according to claim 10, wherein the cleaning solution contains the fine particles, the organic film avoiding exposure of the first film to the fine particles in the cleaning solution.

25. A cleaning method according to claim 14, wherein the cleaning solution includes fine particles, the film avoiding exposure of the substrate to the fine particles.

26. A cleaning method according to claim 1, wherein the second film covers the first film such that exposure of the first film to the fine particles contained in the cleaning solution is avoided.

27. A cleaning method according to claim 2, wherein the second film covers the aluminum film such that exposure of the aluminum film to the fine particles present in the cleaning solution is avoided.

28. A cleaning method according to claim 3, wherein the second film covers the polysilicon film such that exposure of the polysilicon film to the fine particles present in the cleaning solution is avoided.

29. A cleaning method according to claim 5, wherein the second film covers the first film such that exposure of the first film to the fine particles contained in the cleaning solution is avoided.

30. A cleaning method according to claim 8, wherein the second film covers the aluminum film such that exposure of the aluminum film to the fine particles present in the cleaning solution is avoided.

31. A cleaning method according to claim 9, wherein the second film covers the polysilicon film such that exposure of the polysilicon film to the fine particles present in the cleaning solution is avoided.

32. A cleaning method according to claim 16, wherein the second film covers the first film such that exposure of the first film to the fine particles contained in the cleaning solution is avoided.

33. A cleaning method according to claim 18, wherein the film covers the substrate such that exposure of the film to the fine particles contained in the cleaning solution is avoided.

34. A cleaning method according to claim 1, wherein the second film is made of a material having a greater electrostatic repulsive force against fine particles in the cleaning solution than said electrostatic repulsive force of said material of said first film.

35. A cleaning method according to claim 2, wherein the second film is made of a material having a greater electrostatic repulsive force against fine particles in the cleaning solution than said electrostatic repulsive force of said aluminum film.

36. A cleaning method according to claim 3, wherein the second film is made of a material having a greater electrostatic repulsive force against fine particles in the cleaning solution than said electrostatic repulsive force of said polysilicon film.

37. A cleaning method according to claim 4, wherein said two or more films are made of materials having a greater electrostatic repulsive force against fine particles in the cleaning solution than said electrostatic repulsive force of said material of said first film.

38. A cleaning method according to claim 10, wherein the organic film is made of a material having a greater electrostatic repulsive force against fine particles in the cleaning solution than said electrostatic repulsive force of said material of said first film.

39. A cleaning method according to claim 14, wherein said film has a greater zeta potential in an absolute value in the cleaning solution than that of said substrate.

40. A cleaning method according to claim 16, wherein the second film is made of a material having a greater electrostatic repulsive force against fine particles in the cleaning solution than said electrostatic repulsive force of said material of said first film.

41. A cleaning method according to claim 17, wherein said film has a greater zeta potential in an absolute value in the cleaning solution than that of said substrate.

42. A cleaning method according to claim 18, wherein said electrostatic repulsive force of said film is greater than an electrostatic repulsive force, against fine particles present in the cleaning solution, of the substrate.

43. A process for producing a semiconductor device according to claim 19, wherein said electrostatic repulsive force of the second film is greater than the electrostatic repulsive force of the first film.

44. A cleaning method according to claim 22, wherein said film has a greater zeta potential in an absolute value in the cleaning solution than that of said substrate.

* * * * *